US009856685B1

(12) United States Patent
Kelley

(10) Patent No.: US 9,856,685 B1
(45) Date of Patent: Jan. 2, 2018

(54) GARAGE DOOR HINGE WITH NOISE REDUCTION INSERT

(71) Applicant: Robert A. Kelley, Moreno Valley, CA (US)

(72) Inventor: Robert A. Kelley, Moreno Valley, CA (US)

( * ) Notice: Subject to any disclaimer, the term of this patent is extended or adjusted under 35 U.S.C. 154(b) by 0 days.

(21) Appl. No.: 14/810,273

(22) Filed: Jul. 27, 2015

(51) Int. Cl.
*E05D 11/00* (2006.01)
*E05D 15/24* (2006.01)
*E05D 15/16* (2006.01)

(52) U.S. Cl.
CPC ..... *E05D 15/242* (2013.01); *E05D 15/165* (2013.01)

(58) Field of Classification Search
CPC ... Y10T 16/537; Y10T 16/5373; E05D 15/24; E05D 15/242; E05D 15/16; E05D 15/165; E05D 11/02; E05Y 2900/106
See application file for complete search history.

(56) References Cited

U.S. PATENT DOCUMENTS 179,470 A * 7/1876 Buffington ..... E05D 5/14 16/273
2,266,042 A * 12/1941 Hufferd ..... E05D 15/165 16/107
3,015,126 A * 1/1962 Ahlgren ..... E05D 5/127 16/385
3,376,913 A * 4/1968 Clapsaddle ..... E05D 15/165 16/223
3,725,973 A * 4/1973 Gwozdz ..... E05D 5/10 16/273
3,921,225 A * 11/1975 Suska ..... E05D 3/02 16/273
3,939,529 A * 2/1976 Davis ..... E05D 15/466 16/249
3,991,436 A * 11/1976 Nagase ..... E05D 3/02 16/247
4,353,146 A * 10/1982 Brockhaus ..... E05D 5/14 16/273
4,630,332 A * 12/1986 Bisbing ..... E05D 11/087 16/262
5,652,694 A * 7/1997 Martin ..... G06F 1/1616 16/223
5,906,029 A * 5/1999 Fox ..... F16C 11/02 16/221
6,076,590 A * 6/2000 Ford ..... E05D 15/165 16/366
6,718,595 B1 * 4/2004 Berger, Jr. ..... E05D 5/14 16/273
8,443,490 B2 * 5/2013 Forrest ..... E05D 7/02 16/387

(Continued)

FOREIGN PATENT DOCUMENTS

AU 2013101362 A4 * 11/2013

*Primary Examiner* — Chuck Mah
(74) *Attorney, Agent, or Firm* — Thomas I. Rozsa

(57) ABSTRACT

An addition to reduce noise made by a garage door hinge by incorporating two Delrin or hard plastic injection molded washers placed between the two halves of the hinges and slide it over the hinge barrel. This provides a friction reducing pivot point and holds in lubricant. An additional improvement is to hold the barrel in place and reduce the problem of the barrel moving side to side. The improvement will stop or at least significantly reduce the extra noise of the garage door hinge as the garage door moves and provide smoother operation of the hinge.

6 Claims, 5 Drawing Sheets

(56) References Cited

U.S. PATENT DOCUMENTS

| | | | | |
|---|---|---|---|---|
| 2002/0116788 | A1* | 8/2002 | Pompei | E05F 1/063 16/15 |
| 2005/0273976 | A1* | 12/2005 | Sarver | E05D 15/242 16/242 |
| 2013/0104341 | A1* | 5/2013 | Kenerly | E05D 3/02 16/273 |
| 2013/0117966 | A1* | 5/2013 | Branning | E05D 11/00 16/273 |
| 2013/0276265 | A1* | 10/2013 | Friesen | E05D 15/242 16/103 |
| 2014/0090204 | A1* | 4/2014 | Sarnowski | E05D 3/02 16/340 |

* cited by examiner

-PRIOR ART-

GARAGE DOOR HINGE WITH NOISE REDUCTION INSERT

BACKGROUND OF THE INVENTION

1. Field of the Invention

The present invention relates to the field of garage doors and in particular to the hinges located between garage door panels to enable the sectional garage door (made up of three or more sections) to roll on tracks above the interior of the garage and down on tracks and back into its vertical position in front of the interior of the garage.

2. Description of the Prior Art

There is a need for an improved and quieter garage door hinge. The industry standard hinge has not changed very much over the past 50 years. One change has been to change the shape or thickness of the garage door hinges. Some manufacturers have made changes such as removing some material from the hinge such as a small scallop on the edge of the hinge.

Some manufacturers have made plastic hinges for wet environments such as car wash doors. Some have been advertised to be quieter and offer lower maintenance but the drawback to using plastic hinges is that they cost more than metal hinges and do not have the same strength as galvanized steel hinges.

There is significant need for a quieter garage door hinge.

SUMMARY OF THE INVENTION

The present invention is an improved quieter garage door hinge. The standard galvanized steel garage door hinges allow the sectional garage door (made up of three or more sections) to roll up above the garage interior and roll down in front of the garage interior with the support of steel tracks. Each section bends and pivots while rolling through the radius of the track. Without the use of the garage door hinges, the door would not have the flexibility to follow the turn (radius) in the track.

The problem with the standard garage door hinges is that they are noisy, even after lubrication. Industry standard hinges have a very loose design where the barrel inside of the hinge moves side to side, causing the loud rattling noise that is heard when the door is in motion. Even the use of lubricants is not enough fill the void in the hinge to stop the noise.

The present invention is to incorporate two hard thermoplastic injection molded washers such as Delrin injection molded washers placed between the two halves of the hinge and slide it over the hinge barrel. This provides a friction reducing pivot point and holds in lubricant. The present invention improvement will hold the barrel in place and reduce the problem of the barrel moving side to side. The present invention improvement will stop or at least significantly reduce the extra noise and provide smoother operation of the hinge.

In addition, the hinge must be made with tighter tolerances than the conventional hinges. This will allow the hinge to still move freely but not move back and forth and clack while the sections are rolling up and down.

An additional improvement of the present invention is to crimp and expand the hinge barrel very tight and not allow it to rotate such as other hinge designs currently in the market. A locked hinge barrel paired with the Delrin washers and tighter hole tolerance will improve the function of the hinge and enable the hinge to be more quiet than prior art hinges and function more smoothly as compared to the industry standard design for garage door hinges.

In summary, the main objects of the present invention are:

(1) to incorporate two spaced apart washers selected from the group consisting of Delrin, hard thermoplastic injection molded washers and washers made of solid material, the first washer slid around the hinge barrel and positioned between a first arm of an exterior hinge plate and a second arm of an interior hinge plate, and with a second washer slid around the hinge barrel and positioned between a first arm of an exterior hinge plate and a second arm of an interior hinge plate to reduce noise;

(2) to provide tighter hole tolerances to reduce noise; and (3) incorporate the improvement into galvanized steel garage door hinges.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Key improvements of the present invention is an addition to reduce noise made by a garage door hinge by incorporating two washers with a respective first washer slid over the hinge barrel at a location between adjacent arms on a first side of the two hinge plates and a respective second washer slid over the hinge barrel at a location between adjacent arms on a second side of the two hinge plates and through which arms the hinge barrel extends. This provides a noise reduction improvement by avoiding metal to metal contact between adjacent hinge plate arms and also reduces movement of the hinge barrel. This also creates a friction reducing pivot point and holds in lubricant. An additional improvement is to hold the barrel in place and reduce the problem of the barrel moving side to side. The improvement will stop or at least significantly reduce the extra noise of the garage door hinge as the garage door moves and provide smoother operation of the hinge.

Figure 1:
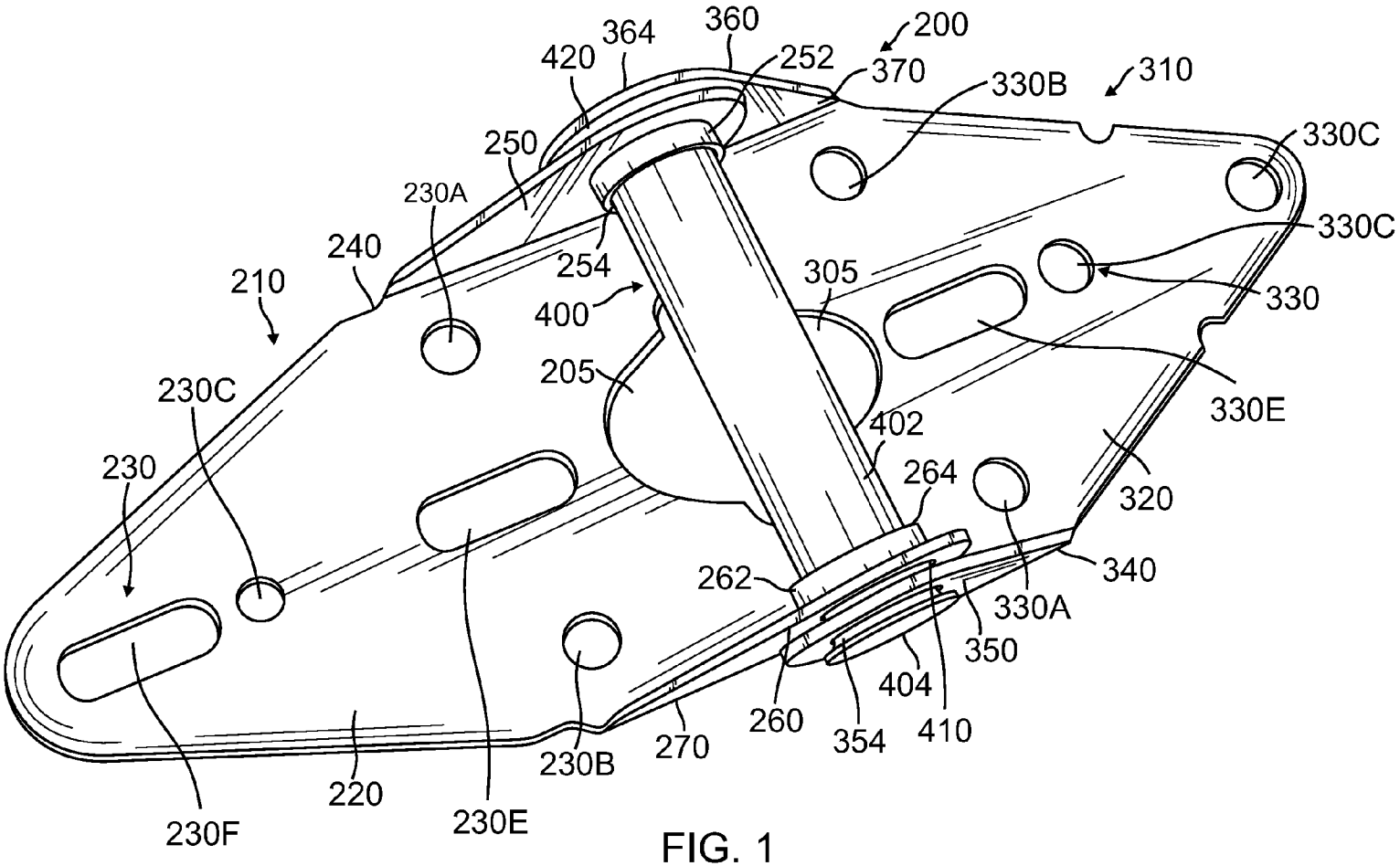
FIG. 1 is a top and side perspective view of a prior art garage door hinge.
Figure 2:
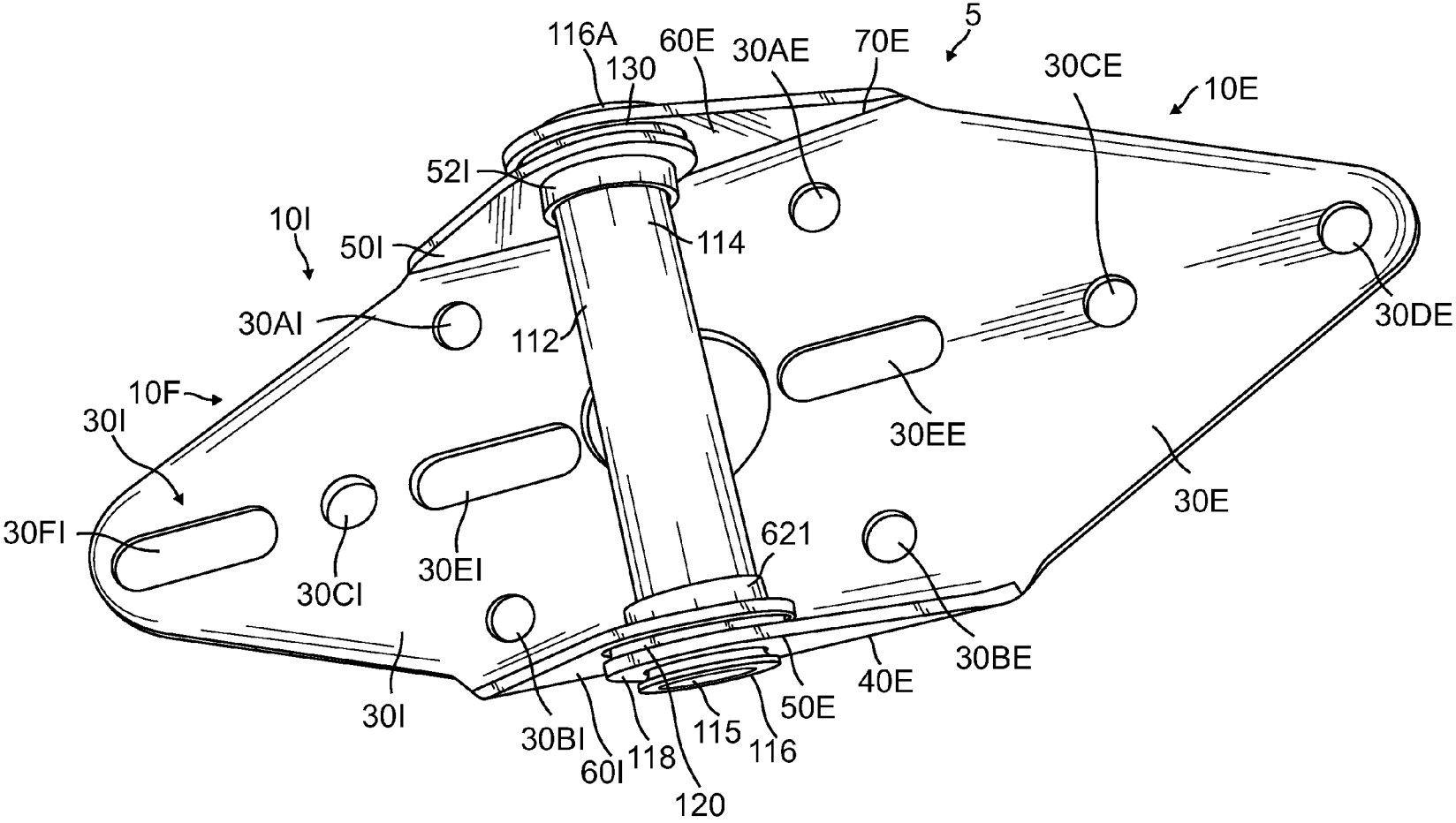
FIG. 2 is a top and side perspective view of the garage door hinge incorporating the present invention.
Figure 3:
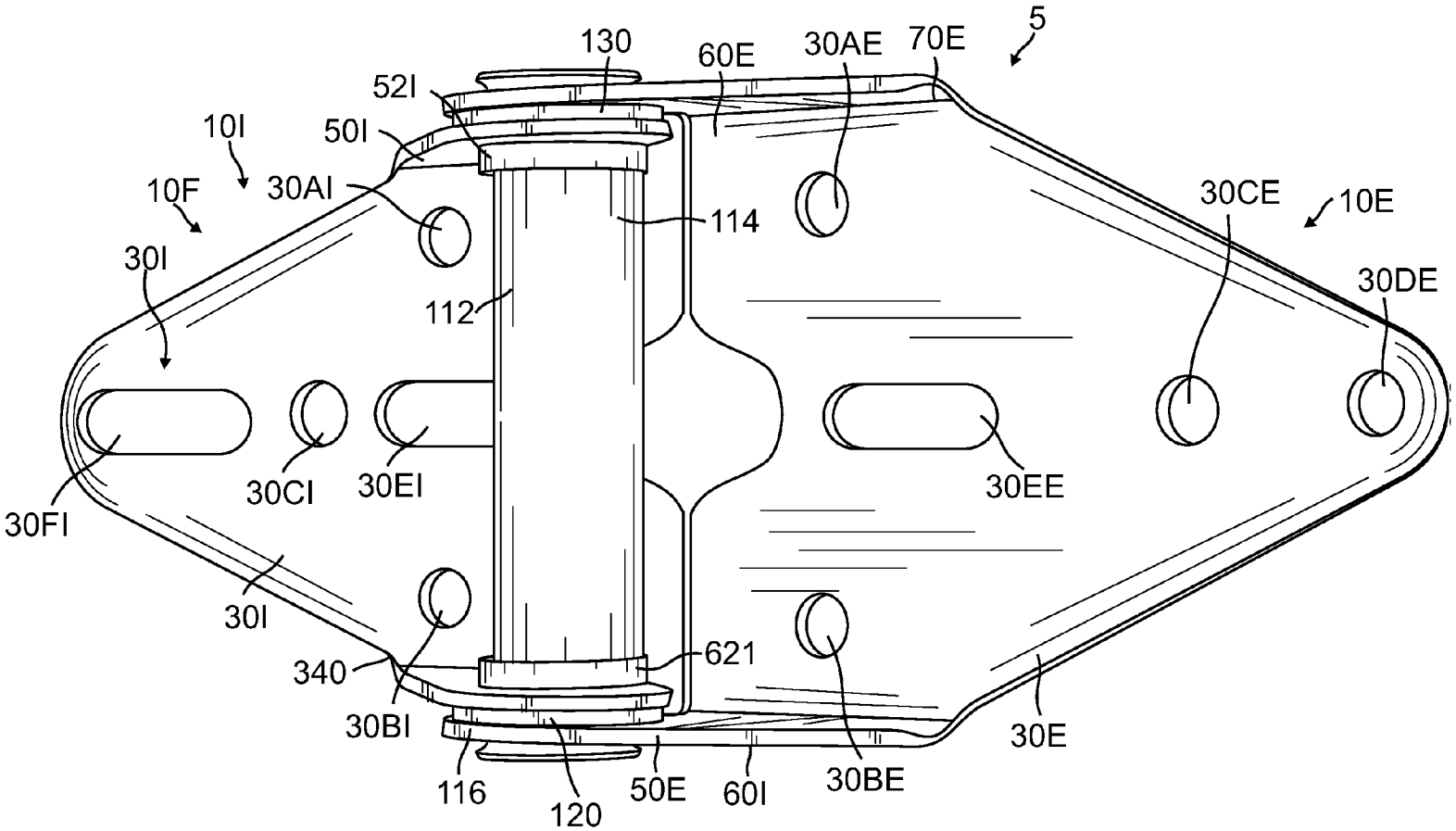
FIG. 3 is a top plan view of the garage door hinge incorporating the present invention.
Figure 4:
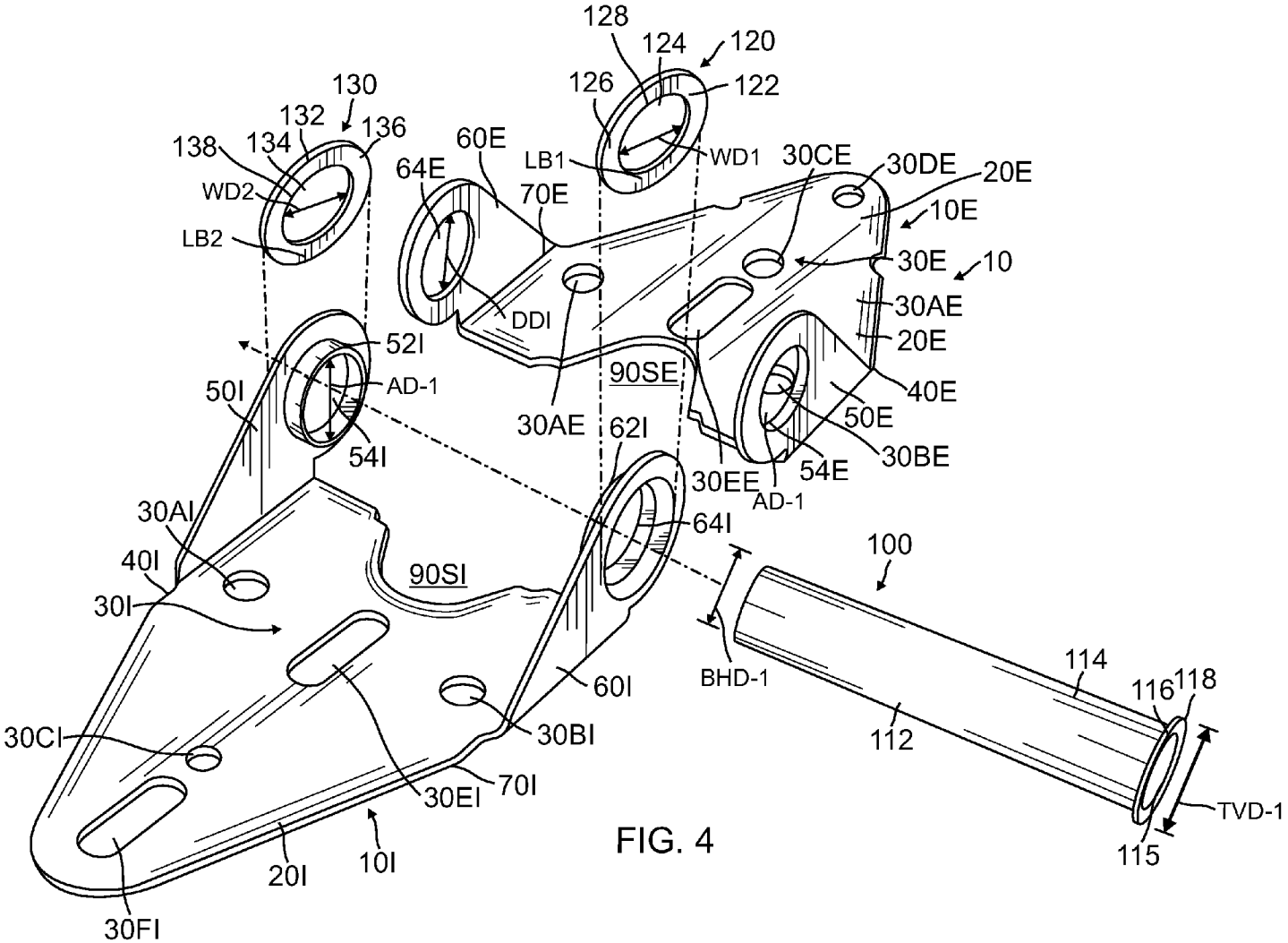
FIG. 4 is an exploded view of the garage door hinge incorporating the present invention.
Figure 5:
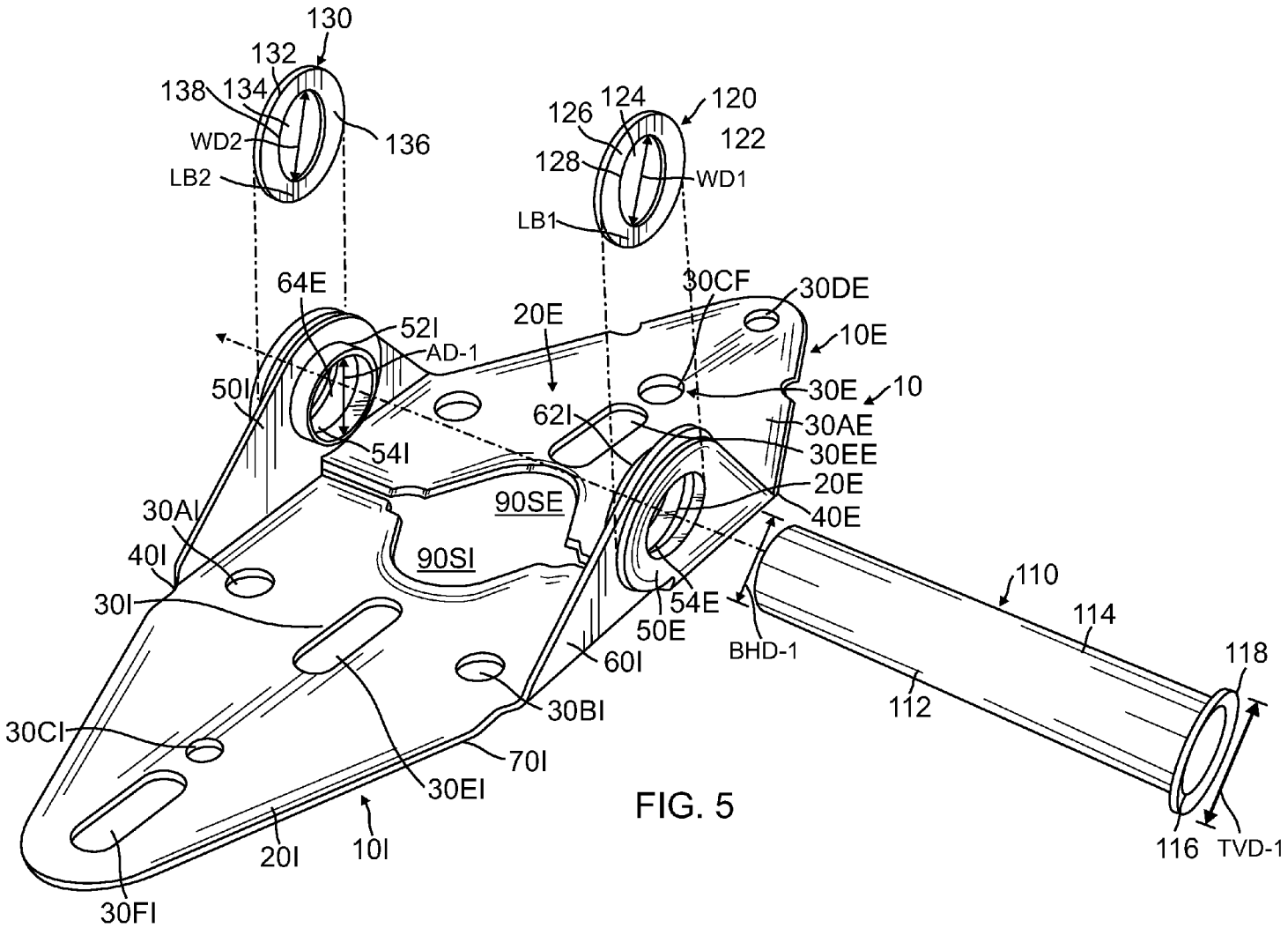
FIG. 5 is another exploded view of the garage door hinge incorporating the present. invention.

Referring to FIG. 1 prior art, the prior art hinge 200 includes an interior prior art attaching plate 210 having a first prior art attaching plate member 220 with a multiplicity of openings 230 which include circular openings 230A, 230B and 230C and slotted openings 230E and 230F, each of which accommodate a respective attaching member extending through a respective one of the multiplicity of openings 230 to affixed the interior prior art attaching plate member 220 to a garage door panel. The attaching member (not shown) is selected from the group consisting of screws, bolts and rivets. An integrally formed prior art first arm 250 is integrally formed on a first side 240 of prior art first attaching plate member 220. The prior art first arm 250 includes an interior first collar 252 with an opening 254 extending through the first collar 252 and an aligned portion of prior art first arm 250. An integrally formed prior art second arm 260 is integrally formed on a second side 270 of prior art first attaching plate member 220. The prior art second arm 260 includes an interior second collar 262 with an opening 264 extending through the second collar 262 and an aligned portion of prior art second arm 260. The 200 series of numbers refer to the prior art interior attaching plate 210.

Further referring to FIG. 1 prior art, the prior art hinge 200 includes an exterior prior art attaching plate 310 having a first prior art attaching plate member 320 with a multiplicity of openings 330 which include circular openings 330A, 330B, 330C and 330D and slotted opening 330E, each of which accommodate a respective attaching member extending through a respective one of the multiplicity of openings 330 to affix the exterior prior art attaching plate member 320 to a garage door panel. The attaching members (not shown) is selected from the group consisting of screws, bolts and rivets. An integrally formed prior art first arm 350 is integrally formed on a first side 340 of prior art first attaching plate member 320. The prior art first arm 350 has an opening 354 extending through the prior art first arm 350. An integrally formed prior art second arm 360 is integrally formed on a second side 370 of prior art first attaching plate member 320. The prior art second arm 360 has an opening 364 extending through the prior art second arm 360.

Opening 354 and 364 are aligned. The 300 series of numbers refer to the prior art exterior attaching plate 310.

The prior art exterior attaching plate 310 and the prior art interior attaching plate 210 are aligned so that prior art first arm 350 is exterior to and aligned with prior art second arm 260 with openings 354 and 264 aligned and prior art second arm 360 is exterior to and aligned with prior art first arm 250 with openings 364 and 254 aligned. A hinge barrel 400 having a cylindrical barrel portion 402 and a stopping plate 404 extends through aligned openings 354, 264, 254 and 364 to rotatably retain the prior art exterior attaching plate 310 and the prior art interior attaching plate 210 together to form prior art hinge 200. Each prior art attaching plate can optionally have a scalloped portion 205 and 305. A first gap 410 is between first arm 350 and second arm 260. A second gap 420 is between second arm 360 and first arm 250. Gaps 410 and 420 contribute to the noise by metal to meta contact between respective adjacent arms 350 and 260 and between respective adjacent arms 4360 and 250.

The prior art hinge 200 is positioned between two adjacent garage door panels so the hinge barrel 400 is positioned in the gap between two adjacent garage door panels, and one attachment plate is affixed to one garage door panel and the other attachment plate is affixed to an adjacent garage door panel. A multiplicity of hinges are respectively affixed to two adjacent pairs of garage door panels, with each garage door panel hingeably attached to an adjacent panel by a hinge 200.

The present invention is illustrated in FIGS. 2 through 5. The components of the present invention hinge 10 are comparable to the prior art. There may be different round openings and slots in the present invention attaching plates by which the present invention hinge 10 is attached to two adjacent garage door panels but the present invention focuses on the insert of a washer as defined above slid onto the hinge barrel to separate the arms of the exterior attaching plate from the arms of the interior attaching plate.

Referring to FIGS. 1 through 5, the present invention hinge 5 includes an interior attaching plate 10I having a first interior attaching plate member 20I with a multiplicity of openings 30I which include circular openings 30AI, 30BI and 30CI and slotted openings 30EI and 30FI, each of which accommodate a respective attaching member extending through a respective one of the multiplicity of openings 30I to affixed the interior attaching plate member 20I to a garage door panel. The attaching members (not shown) is selected from the group consisting of screws, bolts and rivets. An integrally formed interior first arm 50I is integrally formed on an interior first side 40I of interior first attaching plate member 20I. The interior first arm 50I includes an interior first collar 52I with an opening 54I extending through the interior first collar 52I and an aligned portion of interior first arm 50I. An integrally formed interior second arm 60I is integrally formed on an interior second side 70I of interior first attaching plate member 20I. The interior second arm 60I includes an interior second collar 62I with an opening 64I extending through the second collar 62I and an aligned portion of interior second arm 60I.

Further referring to FIG. 2 through 5, the present invention hinge 5 includes an exterior attaching plate 10E having a second exterior attaching plate member 20E with a multiplicity of openings 30E which include circular openings 30AE, 30BE, 30CE and 30DE and slotted opening 30EE, each of which accommodates a respective attaching member extending through a respective one of the multiplicity of openings 30E to affix the exterior attaching plate member 20E to a garage door panel. The attaching members (not shown) is selected from the group consisting of screws, bolts and rivets. An integrally formed exterior first arm 50E is integrally formed on a first side 40E of second exterior attaching plate member 20E. The exterior first arm 50E has an opening 54E extending through the exterior first arm 50E. An integrally formed exterior second arm 60E is integrally formed on an exterior second side 70E of exterior second attaching plate member 20E. The exterior second arm 60E has an opening 64E extending through the exterior second arm 60E. Opening 54E and 64I are aligned. Openings 64E and 54I are aligned.

The exterior attaching plate 10E and the interior attaching plate 10I are aligned so that first arm 50E is exterior to and aligned with second arm 60I with openings 54E and 64I aligned and second arm 60E is exterior to and aligned with first arm 50I with openings 54I and 64E.

A hinge barrel 100 has a cylindrical barrel portion 112 with an outer wall 114 surrounding interior opening 115 and a stopping plate 116. The outer wall 114 is sized to enable the hinge barrel portion 112 to extend through aligned openings 54E, 64I, 54I and 64E has to rotatably retain the exterior attaching plate 10E and the interior attaching plate 10I together to form hinge 5. Each attaching plate can optionally have a scalloped portion 905E and 905I. Each opening 54E, 64I, 54I and 64E has a first diameter "AD−1". The outer wall 114 of cylindrical barrel portion 112 has a diameter "BHD−1" which enables the cylindrical barrel portion 112 to be inserted through openings 54E, 64I, 54I and 64E has. The stopping plate 116 is integral with and extends around and outwardly from a first end 112F of the cylindrical barrel portion 112. The stopping plate 116 has a transverse wall 118 which has a diameter "TVD−1" which is larger than diameter "AD−1".

A key innovation of the present invention is to place a first washer 120 having a body 122 with a central opening 124 having a diameter "WD−1" which is larger than "BHD−1" around outer wall 114 of the barrel portion 112 of hinge barrel 110 and to also place a a second washer 130 having a body 132 with a central opening 134 having a diameter "WD−2" which is larger than "BHD−1" around outer wall 114 of the barrel portion 112 of hinge barrel 110. The first washer 120 and the second washer 130 are each selected from the group consisting of Delrin, hard thermoplastic injection molded washer, and or washer made of solid material. First washer 120 has lubricant LB1 on exterior face 126 and interior face 128. Second washer 130 has lubricant LB2 on interior face 136 and exterior face 138.

The present invention hinge is assembled by having the exterior attaching plate 10E and the interior attaching plate 10I are aligned so that first arm 50E is exterior to and aligned with second arm 60I with openings 54E and 64I aligned and second arm 60E is exterior to and aligned with first arm 50I with openings 54I and 64E the hinge barrel 100 is inserted so that cylindrical barrel portion 112 is inserted through first exterior arm opening 54E, first washer 120 is inserted onto cylindrical barrel portion 112, the cylindrical barrel portion 112 is inserted through second interior arm opening 64I and through first interior arm opening 54I, the second washer 130 is inserted onto cylindrical barrel portion 112 and the cylindrical barrel portion 112 is inserted through second exterior arm opening 364 with stopping plate 116 preventing further insertion of the cylindrical barrel portion 112 of hinge barrel. At its opposite end, cylindrical barrel portion 112 is crimped 116A to lock the hinge barrel 110 in place. Therefore, first washer 120 separates first arm 50E and second arm 60I and second washer 130 separates first arm 50I and second arm 64E. By eliminating arm to arm contact and therefore metal to metal contact, the noise of the hinge 5 is substantially reduced and the panel attaching plates 10E and 10I rotate relative to each other as the garage door is rained and lowered.

The first washer 120 and the second washer 130 are each selected from the group consisting of Delrin, hard thermoplastic injection molded washer, and or washer made of solid material)

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. A hinge for use in conjunction with adjacent garage door panels, the hinge including an interior attaching plate having a first interior attaching plate member with openings to respectively receive an attaching member to affix the first interior attaching plate to a first garage door panel, an integrally formed interior first arm integrally formed on an interior first side of interior first attaching plate member and including an interior first collar with an opening extending through the interior first collar and an aligned portion of the interior first arm, an integrally formed interior second arm integrally formed on an interior second side of the interior first attaching plate member and including an interior second collar with an opening extending through the second collar and an aligned portion of the interior second arm, an exterior attaching plate having a second exterior attaching plate member with openings to respectively receive an attaching member to affix the second exterior attaching plate to a second garage door panel, an integrally formed exterior first arm integrally formed on a first side of the second exterior attaching plate member, the exterior first arm having an opening extending through the exterior first arm, an integrally formed exterior second arm integrally formed on an exterior second side of exterior second attaching plate member, the exterior second arm having an opening extending through the exterior second arm, the exterior attaching plate and the interior attaching plate are aligned so that the first arm of the exterior attaching plate is exterior to and aligned with the second arm of the interior attaching plate and the second arm of the exterior attaching plate is exterior to and aligned with the first arm of the interior attaching plate, respective openings of aligned arms are aligned with each other, a hinge barrel having a cylindrical barrel portion with an outer wall and a stopping plate integral with and extending from an outer wall of the cylindrical barrel portion, each aligned opening of each respective first and second arm of the exterior attaching plate and the interior attaching plate having a diameter, the outer wall of the cylindrical barrel portion having a diameter smaller than each diameter of each opening of each arm of the exterior attaching plate and the interior attaching plate, the outer wall of the cylindrical barrel portion sized to enable the hinge barrel to extend through the aligned openings of the respective first and second arms of the exterior attaching plate and the interior attaching plate, the stopping plate having a diameter larger than at least the opening of the first exterior arm of the exterior attaching plate, the hinge further comprising:

a. a first washer with a central opening having a diameter which is larger than a diameter of the outer wall of the cylindrical barrel portion, and a spaced apart second washer with a central opening having a diameter which is larger than a diameter of the outer wall of the cylindrical barrel portion;

b. the cylindrical barrel portion extending through the opening in the first exterior arm, extending through the opening in the first washer, inserted through second interior arm opening and through first interior arm opening through the opening in the second washer and through second exterior arm opening, the stopping plate abuts and does not pass through an exterior wall of the first exterior arm, with the stopping plate at a first end of the cylindrical barrel portion and the second end of the cylindrical barrel portion crimped and expanded at a location exterior to the second exterior arm;

c. the first washer separating the first exterior arm and the second interior arm and the second washer separating the first interior arm and the second exterior arm, the first interior arm, the second interior arm, the first exterior arm and the second exterior arm are each made of metal;

d. the first washer is made of material selected from the group consisting of Delrin, hard thermoplastic injection molded washer, and washer made of solid material and the second washer is made of material selected from the group consisting of Delrin, hard thermoplastic injection molded washer, and washer made of solid material;

e. the first washer having an exterior face with a first lubricant thereon and an interior face with a first lubricant thereon, and the second washer having an interior face with a second lubricant thereon and an exterior face with a second lubricant thereon; and f. wherein, said location of said first washer, said material out of which said first washer is made and said first lubricant on said first washer, said location of said second washer, said material out of which said second washer is made and said second lubricant on said second washer causes the first washer to eliminate contact between the first exterior arm and the second interior arm, and causes the second washer to eliminate contact between the first interior arm and the second exterior arm and the second end of the cylindrical barrel portion crimped and expanded at a location exterior to the second exterior arm locks the cylindrical barrel portion and prevents the cylindrical barrel portion from rotating relative to the exterior attaching plate and moving from side to side and the combination between the first and second washer eliminating metal to metal contact between the first exterior arm and the second interior arm and the first interior arm and the second exterior arm and the locking of the hinge barrel reduces noise from the hinge as the hinge is caused to rotate when garage door having panels with adjacent panels connected through the hinge move up and down.

2. A hinge for use in conjunction with adjacent garage door panels, the hinge including an interior attaching plate having an interior first arm with an opening, the interior attaching plate having an interior second arm with an opening, an exterior attaching plate having an interior first arm with an opening, the exterior attaching plate having an exterior second arm with an opening, the exterior attaching plate and the interior attaching plate are aligned so that the exterior first arm of the exterior attaching plate is exterior to and aligned with the interior second arm of the interior attaching plate and the exterior second arm of the exterior attaching plate is exterior to and aligned with the interior first arm of the interior attaching plate, respective openings of aligned arms are aligned with each other, a hinge barrel having a cylindrical barrel portion with an outer wall and a stopping plate integral with and extending from an outer wall of cylindrical barrel portion, the outer wall sized to enable the hinge barrel portion to extend through aligned openings of the respective exterior and interior first and second arms of the exterior attaching plate and the interior attaching plate, the stopping plate having a diameter larger than at least the opening of the first exterior arm of the exterior attaching plate, the hinge further comprising:

a. a first washer with a central opening having a diameter which is larger than a diameter of the outer wall of the cylindrical barrel portion, and a spaced apart second washer with a central opening having a diameter which is larger than a diameter of the outer wall of the cylindrical barrel portion;

b. the cylindrical barrel portion extending through the opening in the first exterior arm, extending through the opening in the first washer, inserted through the second interior arm opening and through the first interior arm opening through the opening in the second washer and through second exterior arm opening, with the stopping plate exterior to a first end of the cylindrical barrel portion and abutting and not extending through the opening in the first arm, the second end of the cylindrical barrel crimped and expanded to lock the hinge barrel in place to prevent rotation of the hinge barrel relative to the exterior attaching;

c. the first washer separating the first exterior arm and the second interior arm and the second washer separating the first interior arm and the second exterior arm, the first interior arm, the second interior arm, the first exterior arm and the second exterior arm are each made of metal;

d. the first washer is made of material selected from the group consisting of Delrin, hard thermoplastic injection molded washer, and washer made of solid material and the second washer is made of material selected from the group consisting of Delrin, hard thermoplastic injection molded washer, and washer made of solid material;

e. the first washer having an exterior face with a first lubricant thereon and an interior face with a first lubricant thereon, and the second washer having an interior face with a second lubricant thereon and an exterior face with a second lubricant thereon; and f. said location of said first washer, said material out of which said first washer is made and said first lubricant on said first washer, said location of said second washer, said material out of which said second washer is made and said second lubricant on said second washer causes the first washer to eliminate contact between the first exterior arm and the second interior arm, combined with the crimping and expansion of the second end of the exterior barrel portion to prevent the cylindrical barrel portion from moving side to side and from rotating and the elimination of metal to metal contact and prevention of rotation of the cylindrical barrel portion reduces noise from the hinge as the hinge is caused to rotate when a garage door having panels with adjacent panels connected through the hinge moves up and down.

3. A hinge comprising:

a. an interior attaching plate having an interior first arm with an opening, the interior attaching plate having an interior second arm with an opening, an exterior attaching plate having an exterior first arm with an opening, the exterior attaching plate having an exterior second arm with an opening, the exterior attaching plate and the interior attaching plate are aligned so that the exterior first arm of the exterior attaching plate is exterior to and aligned with the interior second arm of the interior attaching plate and the exterior second arm of the exterior attaching plate is exterior to and aligned with the interior first arm of the interior attaching plate, respective openings of aligned arms are aligned with each other;

b. a hinge barrel having a cylindrical barrel portion with an outer wall and a stopping plate integral with and extending from an outer wall of cylindrical barrel portion, the outer wall sized to enable the hinge barrel portion to extend through aligned openings of the respective exterior and interior first and second arms of the exterior attaching plate and the interior attaching plate and the stopping plate adjacent an exterior wall of the first exterior arm and the hinge barrel crimped and expanded at a location exterior to the second exterior arm prevents the hinge barrel relative to the exterior attaching plate from rotating and retains the exterior attaching plate and the interior attaching plate together to form the hinge;

c. a first washer with a central opening having a diameter which is larger than a diameter of the outer wall of the cylindrical barrel portion, and a spaced apart second washer with a central opening having a diameter which is larger than a diameter of the outer wall of the cylindrical barrel portion;

d. the first washer separating the first exterior arm and the second interior arm and the second washer separating the first interior arm and the second exterior arm, the first interior arm, the second interior arm, the first exterior arm and the second exterior arm are each made of metal;

e. the first washer is made of material selected from the group consisting of Delrin, hard thermoplastic injection molded washer, and washer made of solid material and the second washer is made of material selected from the group consisting of Delrin, hard thermoplastic injection molded washer, and washer made of solid material;

f. the first washer having an exterior face with a first lubricant thereon and an interior face with a first lubricant thereon, and the second washer having an interior face with a second lubricant thereon and an exterior face with a second lubricant thereon; and g. said location of said first washer, said material out of which said first washer is made and said first lubricant on said first washer, said location of said second washer, said material out of which said second washer is made and said second lubricant on said second washer causes the first washer to eliminate contact between the first exterior arm and the second interior arm, and the second washer to eliminate contact between the first interior arm and the crimping and expansion of the cylindrical hinge barrel to prevent the rotation of the cylindrical hinge barrel prevents the cylindrical barrel portion from rotating and moving side to side and elimination of metal to metal contact combined with the locking of the cylindrical hinge barrel reduces noise from the hinge as the hinge is caused to rotate when a garage door having panels with adjacent panels connected through the hinge moves up and down.

4. A hinge comprising:

a. an interior attaching plate having an interior first arm with an opening, the interior attaching plate having an interior second arm with an opening, an exterior attaching plate having an exterior first arm with an opening, the exterior attaching plate having an exterior second arm with an opening, the exterior attaching plate and the interior attaching plate are aligned so that exterior first arm of the exterior attaching plate is exterior to and aligned with interior second arm of the interior attaching plate and the exterior second arm of the exterior attaching plate is exterior to and aligned with interior first arm of the interior attaching plate, respective openings of aligned arms are aligned with each other;

b. a hinge barrel having a cylindrical barrel portion with an outer wall and a stopping plate integral with and extending from an outer wall of cylindrical barrel portion, the outer wall sized to enable the hinge barrel portion to extend through aligned openings of the respective exterior and interior first and second arms of the exterior attaching plate and the interior attaching plate and the stopping plate adjacent an exterior wall of the first exterior arm and the hinge barrel crimped and expanded at a location exterior to the second exterior arm prevents the hinge barrel from rotating relative to the exterior attaching plate and retains the exterior attaching plate and the interior attaching plate together to form the hinge;

c. a first washer with a central opening having a diameter which is larger than a diameter of the outer wall of the cylindrical barrel portion, and a spaced apart second washer with a central opening having a diameter which is larger than a diameter of the outer wall of the cylindrical barrel portion;

d. the first washer separating the first exterior arm and the second interior arm and the second washer separating the first interior arm and the second exterior arm, the first interior arm, the second interior arm, the first exterior arm and the second exterior arm are each made of metal;

e. said location of said first washer to eliminate contact between the first exterior arm and the second interior arm and said location of said second washer eliminates contact between the first interior arm and the second exterior arm, and the crimping and expansion of the cylindrical hinge barrel to prevent the rotation of the cylindrical hinge barrel prevents the cylindrical barrel portion from rotating and moving side to side and eliminates the metal to metal contact combined with the locking of the cylindrical hinge barrel reduces noise from the hinge as the hinge is caused to rotate when a garage door having panels with adjacent panels connected through the hinge moves up and down.

5. The hinge in accordance with claim 4, further comprising:

the first washer is made of material selected from the group consisting of Delrin, hard thermoplastic injection molded washer, and washer made of solid material and the second washer is made of material selected from the group consisting of Delrin, hard thermoplastic injection molded washer, and washer made of solid material.

6. The hinge in accordance with claim 4, further comprising:

the first washer having an exterior face with a first lubricant thereon and an interior face with a first lubricant thereon, and the second washer having an interior face with a second lubricant thereon and an exterior face with a second lubricant thereon.

* * * * *